US005165430A

United States Patent [19]

Porter

[11] Patent Number: 5,165,430

[45] Date of Patent: Nov. 24, 1992

[54] HAIR CLASP CONSTRUCTION

[76] Inventor: Peggy A. Porter, R.F.D. #1, Box 46, Putney, Vt. 05346

[21] Appl. No.: 826,082

[22] Filed: Jan. 27, 1992

[51] Int. Cl.[5] ..... A45D 8/22

[52] U.S. Cl. ..... 132/279; 132/278

[58] Field of Search ..... 132/254, 255, 273, 275, 132/276, 277, 278, 279

[56] References Cited

U.S. PATENT DOCUMENTS

| | | | |
|---|---|---|---|
| 1,767,681 | 6/1930 | Kapustka | 132/276 |
| 1,982,767 | 12/1934 | Solomon | 132/277 |
| 2,749,920 | 6/1956 | Kriesman et al. | 132/277 |
| 2,781,046 | 2/1957 | Moorhead | 132/277 |
| 2,793,644 | 5/1957 | Todfield | 132/277 |
| 3,645,278 | 2/1972 | Abraham | 132/278 |
| 4,753,252 | 6/1988 | Boxer | 132/279 |

*Primary Examiner*—Gene Mancene
*Assistant Examiner*—Frank A. LaViola
*Attorney, Agent, or Firm*—Leon Gilden

[57] ABSTRACT

A hair clasp is arranged to include a top plate mounting a flexible bottom clamp plate relative to the top plate, wherein the bottom clamp plate includes a rib received within a resilient receiving channel to secure hair portions between the clamp plate and top plate. The top plate is formed in a variety of configurations for securing hair between the top plate and the clamp plate, as well as a modification for permitting projection of various hair fluids into the organization between the top plate and clamp plate.

2 Claims, 5 Drawing Sheets

HAIR CLASP CONSTRUCTION

BACKGROUND OF THE INVENTION

1. Field of the Invention

The field of the invention relates to hair clasp apparatus, and more particularly pertains to a new and improved hair clasp construction wherein the same is arranged to accommodate hair therebetween in an adjustable manner.

2. Description of the Prior Art

Hair clasps of various types are utilized throughout the Prior art to secure hair during a drying or training procedure. Such clasp or clip structure is exemplified in U.S. Pat. No. 4,753,252 to Boxer; U.S. Pat. no. 3,456,656 to Burgoyne; and U.S. Pat. No. 3,860,014 to Clifton.

The prior art structure has heretofore been of a construction not permitting accommodation of various hair quantities in a manner as set forth by the invention utilizing a flexible member relative to a top plate extending laterally beyond the resilient member and in this respect, the present invention substantially fulfills this need.

SUMMARY OF THE INVENTION

In view of the foregoing disadvantages inherent in the known types of hair clip construction now present in the prior art, the present invention provides a hair clasp construction wherein the same is arranged to adjustably accommodate various hair portions within the hair clasp. As such, the general purpose of the present invention, which will be described subsequently in greater detail, is to provide a new and improved hair clasp construction which has all the advantages of the prior art hair clip constructions and none of the disadvantages.

To attain this, the present invention provides a hair clasp arranged to include a top plate mounting a flexible bottom clamp plate relative to the top plate, wherein the bottom clamp plate includes a rib received within a resilient receiving channel to secure hair portions between the clamp plate and top plate. The top plate is formed in a variety of configurations for securing hair between the top plate and the clamp plate, as well as a modification for permitting projection of various hair fluids into the organization between the top plate and clamp plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair clasp construction which has all the advantages of the prior art hair clip constructions and none of the disadvantages.

It is another object of the present invention to provide a new and improved hair clasp construction which may be easily and efficiently manufactured and marketed.

It is a further object of the present invention to provide a new and improved hair clasp construction which is of a durable and reliable construction.

An even further object of the present invention is to provide a new and improved hair clasp construction which is susceptible of a low cost of manufacture with regard to both materials and labor, and which accordingly is then susceptible of low prices of sale to the consuming public, thereby making such hair clasp constructions economically available to the buying public.

Still yet another object of the present invention is to provide a new and improved hair clasp construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
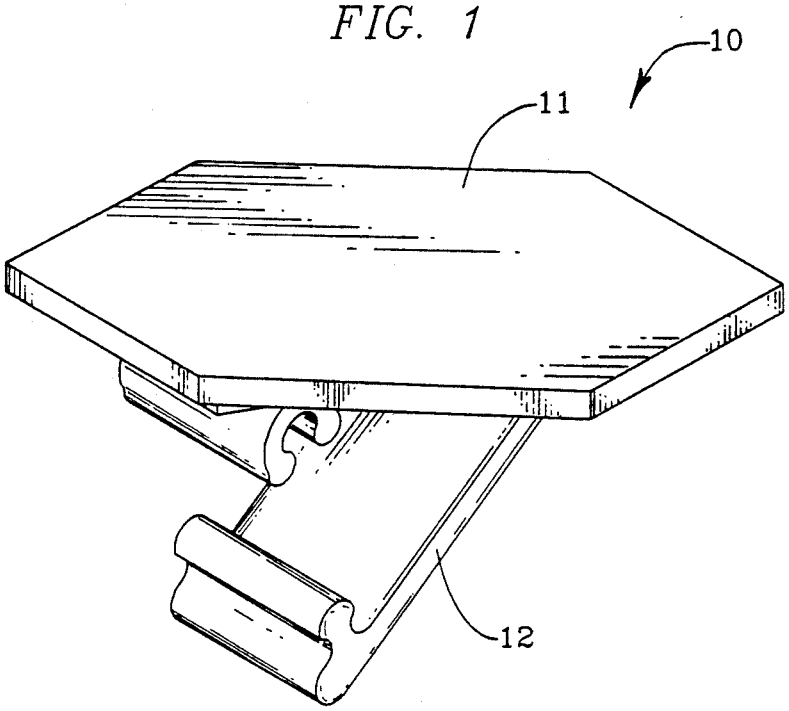
FIG. 1 is an isometric illustration of the invention in an opened configuration.
Figure 2:
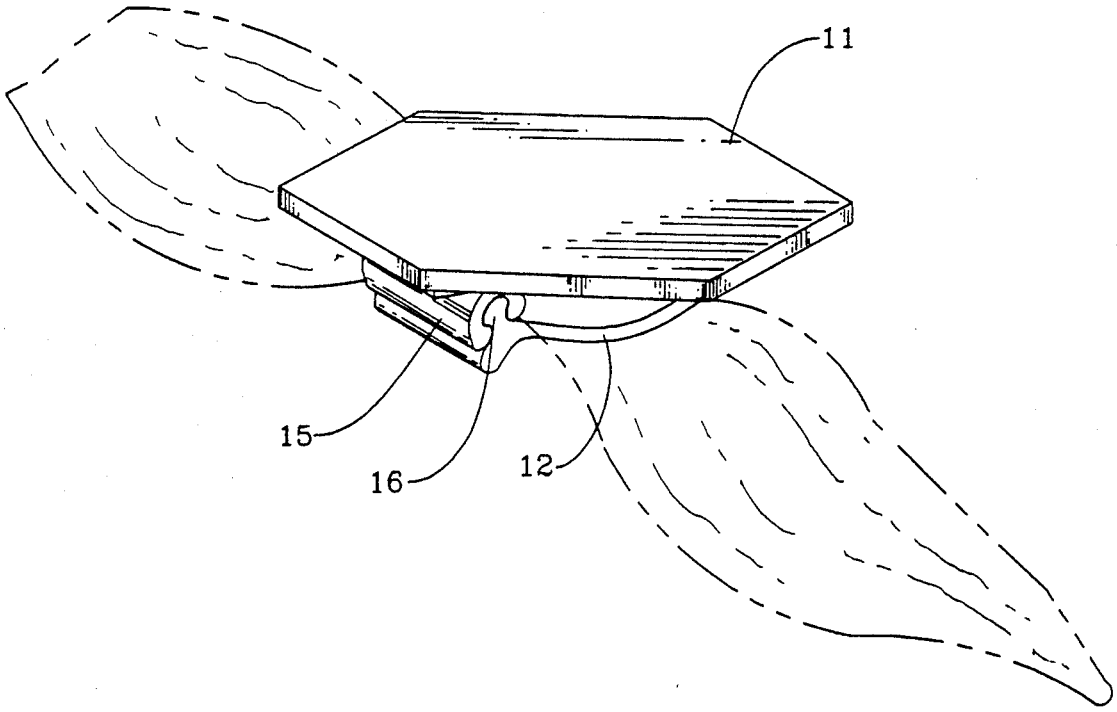
FIG. 2 is an isometric illustration of the invention in a closed configuration.
Figure 3:
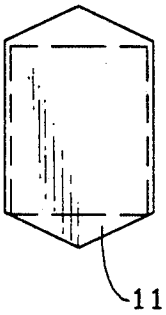
FIGS. 3, 5, 7, 9, and 11 illustrate respective modified top plate members of various configurations and surface area to receive a hair portion therebelow.
Figure 4:
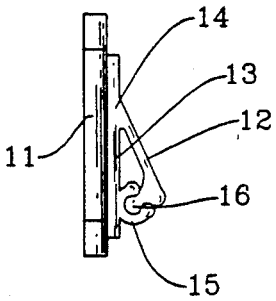
FIGS. 4, 6, 8, 10, and 12 are orthographic side views of the respective FIGS. 3, 5, 7, 9, and 11.
Figure 5:
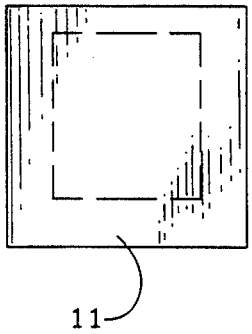
Figure 6:
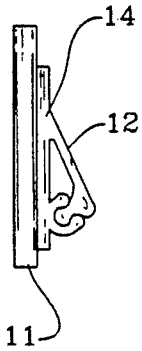
Figure 7:
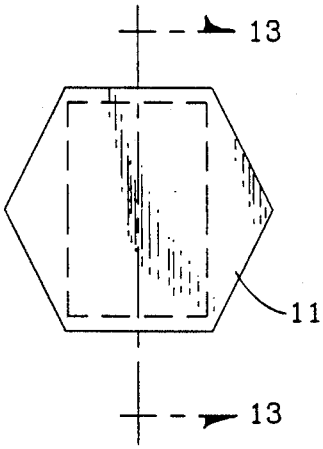
Figure 8:
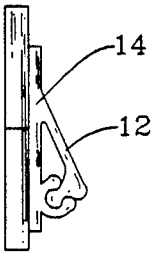
Figure 9:
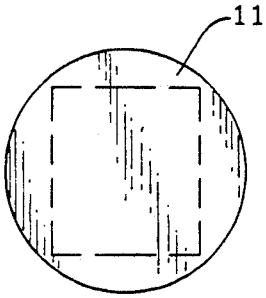
Figure 10:
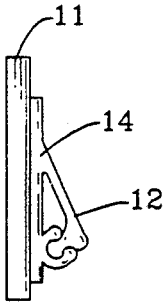
Figure 11:
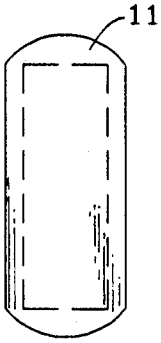
Figure 12:
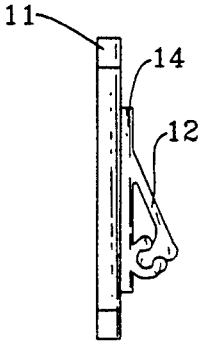
Figure 13:
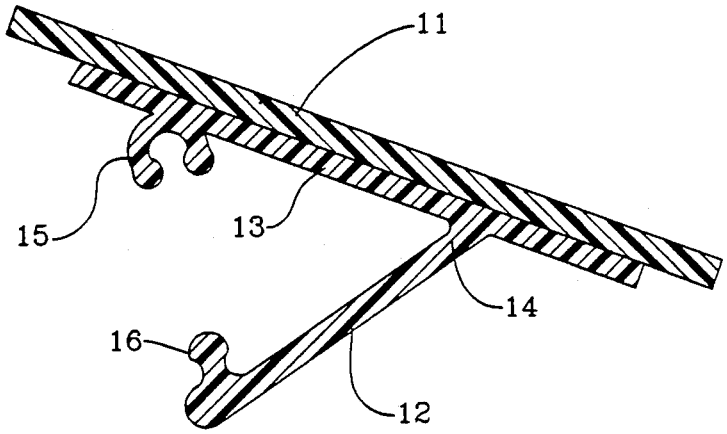
FIG. 13 is an orthographic view, taken along the lines 13—13 of FIG. 7 in the direction indicated by the arrows.

With reference now to the drawings, and in particular to FIGS. 1 to 18 thereof, a new and improved hair clasp construction embodying the principles and concepts of the present invention and generally designated by the reference numerals 10, 10*a*, and 10*b* will be described.

More specifically, the hair clasp construction 10 of the instant invention essentially comprises, and with specific reference to the FIGS. 1–13, a rigid top plate 11, including a flexible bottom clamp plate 12 hingedly mounted below the top plate 11, with the bottom plate 12 mounted about a clamp hinge 14 to a top clamp plate 13 that is fixedly mounted to a bottom surface of the top plate 11. The bottom clamp plate 12 and the top clamp plate 13 are of a substantially equal width, with the rigid top plate 11 extending substantially laterally beyond each side of the bottom and top clamp plates 12 and 13, wherein as illustrated, the bottom and top clamp plates are each formed with a clamp structure at a free distal end of each clamp plate. Specifically, a resilient receiving channel 15 is formed within a forward distal end of the top clamp plate 13 spaced from the hinge 14 a predetermined spacing to receive a latch rib 16 of a complementary "C" shaped cross-sectional configuration relative to the "C" shaped cross-sectional configuration of the receiving channel 15. The resilient bottom clamp plate 12 accommodates a hair portion between the resilient bottom clamp plate and the rigid top plate 11. The top clamp plate 13 is coextensively of its length in contiguous communication with the bottom surface of the top clamp plate 11.

Figure 16:
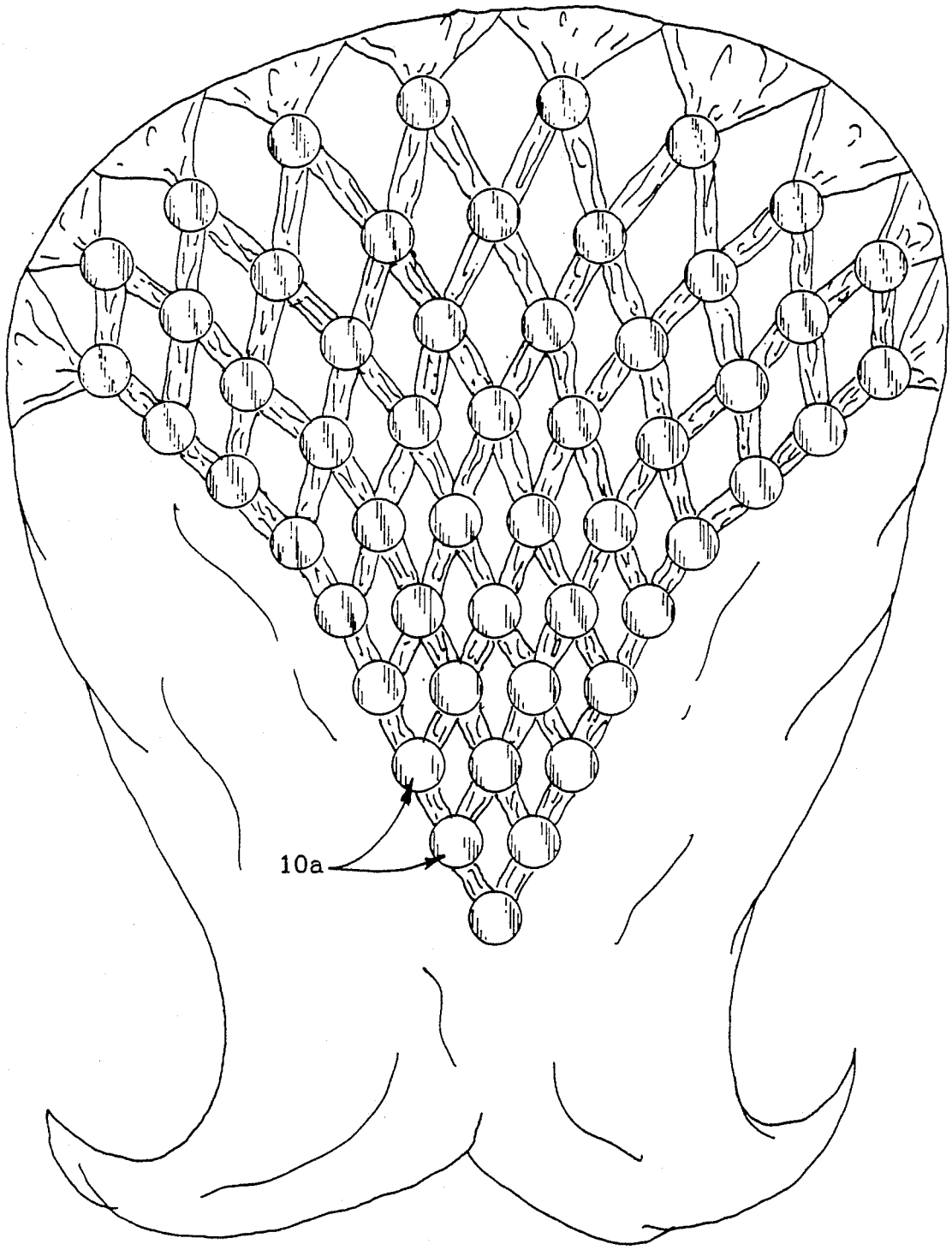
FIG. 16 is an orthographic rear view of the clasp construction as set forth in FIGS. 14 and 15 in use.

The FIGS. 3–12 illustrate modified rigid top plates of various configurations to accommodate various designs of a clamp structure mounted to the hair portions. Various configurations thusly permit various spacing and orientation of the clamps 10 when mounted relative to one another in a pattern, such as illustrated in FIG. 16.

Figure 14:
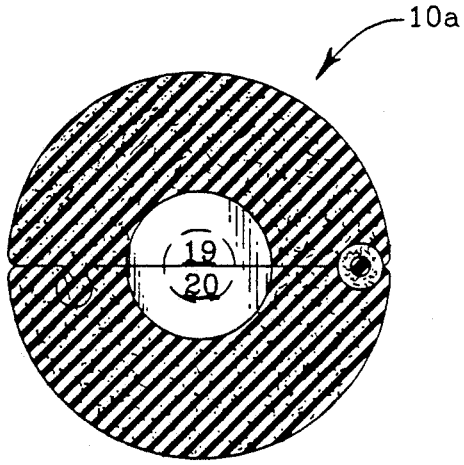
FIG. 14 is an orthographic cross-sectional illustration of a modified clasp structure of the invention.
Figure 15:
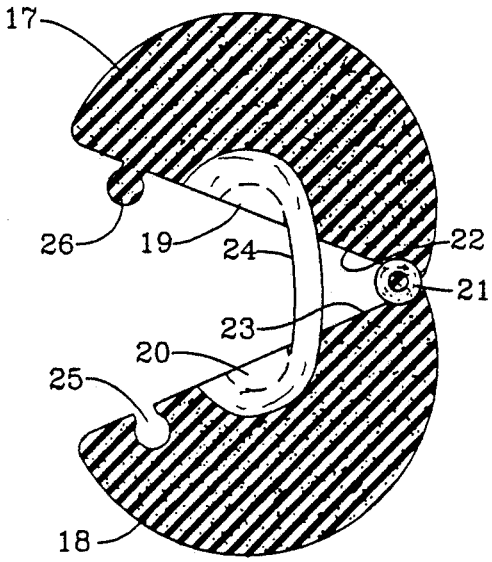
FIG. 15 is the clasp construction of FIG. 4 in an opened configuration.

The FIGS. 14 and 15 illustrate a modified clamp construction 10*a*, including a resilient first clamp shell 17 hingedly mounted to a resilient second clamp shell 18 about a hinge 21. A first semi-cylindrical cavity 19 is formed within a planar first surface 22 of the first clamp shell 17 that is in confrontation to a planar second surface of the second clamp shell 18 that in turn includes a second semi-cylindrical cavity 20, wherein the first and second semi-cylindrical cavities 19 and 20 are in a confronting relationship relative to one another to receive a hair portion therebetween, and wherein an elastomeric shield 24 is mounted between the first and second semi-cylindrical cavities adjacent the hinge 21 to prevent hair portions from entering the hinge 21 and effecting damage and discomfort to an individual in use of the organization. A groove 25 within the second surface 23 receives a rib 26 projecting from the first surface 22 as the rib and groove 26 and 25 respectively are an equal distance from the hinge 21 in a parallel relationship relative to one another and to the hinge 21.

Figure 17:
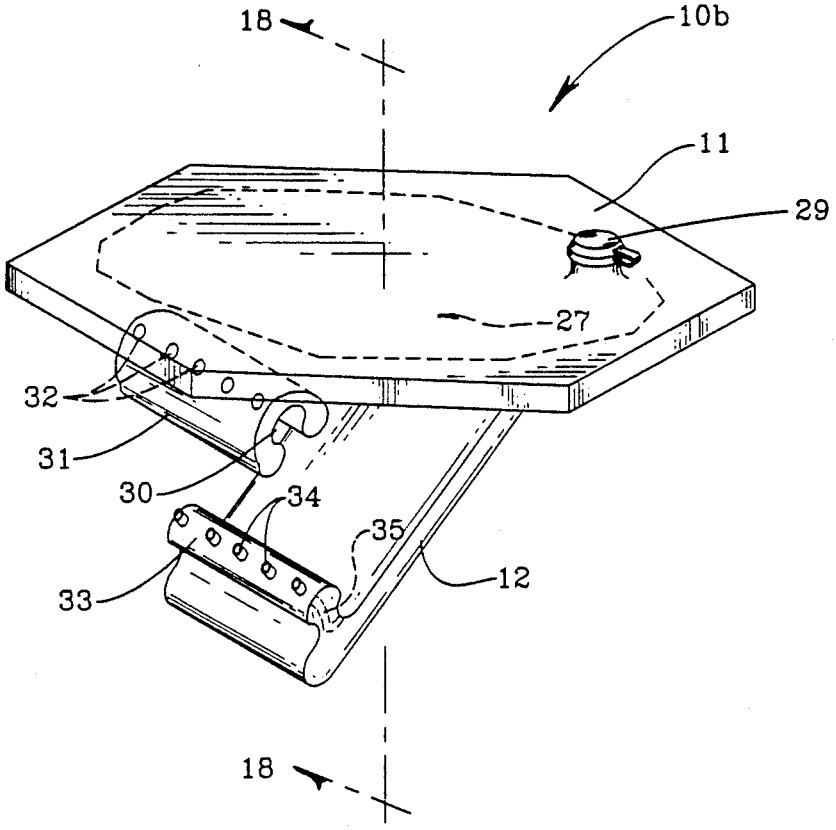
FIG. 17 is an isometric illustration of a further modified clasp construction of the invention.
Figure 18:
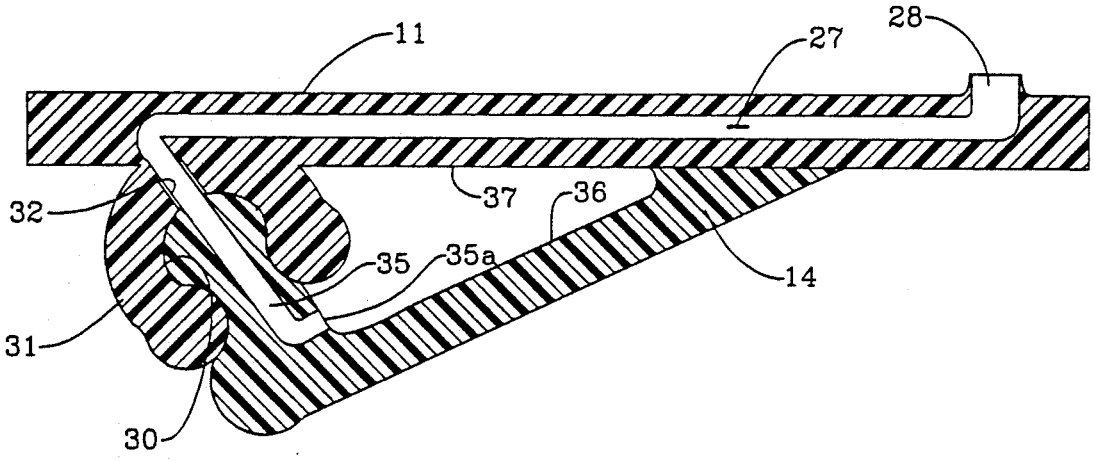
FIG. 18 is an orthographic view, taken along the lines 18—18 of FIG. 17 in the direction indicated by the arrows.

A further modified construction 10*b* is illustrated in FIG. 17, wherein the top plate 11 includes a reservoir 27 including a fill port 28 projecting through a top surface of the top plate 11, wherein a fill cap 29 is hingedly mounted relative to the port 28 permitting selective refilling of the reservoir 27 with various fluid such as hair setting fluids and the like in a hair styling procedure. A clamping channel 30 is formed within a clamping boss 31 that is fixedly mounted to a bottom surface of the top plate 11, and wherein the channel 30 is spaced from the hinge 14 a predetermined spacing equal to a predetermined spacing between a clamping rib 33 mounted to the flexible bottom clamp plate 12. A plurality of first conduits 32 in fluid communication with the reservoir 27 are directed through the boss 31 into the channel 30. Each of the first conduits 32 are arranged to receive a tube 34 that are spaced apart a predetermined distance relative to one another equal to a like predetermined distance between first conduits 32. Each tube 34 is in fluid communication with a port 35, and each port 35 includes a port exit opening projecting through the rib 33. The bottom clamp plate 12 includes a bottom clamp plate interior surface in confrontation or in a face-to-face relationship relative to a top plate interior surface 37, wherein each of the exit openings 35*a* are directed between the interior surfaces 36 and 37 to be directed into hair portions thusly captured between the interior surfaces 36 and 37 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair clasp construction, comprising, a rigid top plate and a flexible bottom clamp plate hingedly mounted to the top plate about a clamp hinge, with the rigid top plate extending laterally beyond the flexible bottom clamp plate, and the top plate including a clamping boss mounted fixedly to a bottom surface of the top plate, and wherein the flexible bottom clamp plate is hingedly mounted to the top plate about an elongate clamp hinge, and the clamping boss is arranged parallel relative to the clamp hinge, and the bottom clamp plate includes a clamping rib, the clamping boss including a clamping channel, the clamping channel arranged parallel relative to the clamp hinge, and the clamping rib arranged parallel to the clamp hinge, with the clamping rib spaced from the clamp hinge the predetermined spacing and complementarily received within the clamping channel, and the top plate includes a reservoir, the reservoir including a reservoir fill port projecting through a top surface of the top plate, the fill port including a fill cap hingedly mounted to the fill port to effect selective filling of the reservoir, and at least one clamping boss conduit directed in the clamping boss in fluid communication with the reservoir and directed into the clamping channel, and the clamping rib including at least one fluid tube projecting exteriorly of the clamping rib and received within the clamping boss conduit, and the clamping rib further including at least one clamping rib port, the clamping rib port in fluid communication with the clamping rib tube, and the clamping rib port including a clamping rib port exit opening directed exteriorly of the clamping rib.

2. An apparatus as set forth in claim 1 wherein the top plate includes a top plate interior surface between the clamping boss and the clamp hinge, and the flexible clamp plate including a top plate interior surface oriented between the clamping rib and the clamp hinge in a facing relationship relative to the top plate interior surface, and the exit opening is oriented between the top plate interior surface and the clamp plate interior surface.

* * * * *